US008919708B1

(12) United States Patent
Graves

(10) Patent No.: US 8,919,708 B1
(45) Date of Patent: Dec. 30, 2014

(54) DUSTPAN WITH GARBAGE BAG SUPPORTING FRAME, FILTER, AND RUNNING BOARDS

(76) Inventor: Robert Graves, Chicago, IL (US)

( * ) Notice: Subject to any disclaimer, the term of this patent is extended or adjusted under 35 U.S.C. 154(b) by 180 days.

(21) Appl. No.: 13/488,613

(22) Filed: Jun. 5, 2012

(51) Int. Cl.

| | |
|---|---|
| ***B65B 67/04*** | (2006.01) |
| ***B65B 1/04*** | (2006.01) |
| ***A47L 13/52*** | (2006.01) |
| ***B65F 1/14*** | (2006.01) |
| ***B65B 67/12*** | (2006.01) |

(52) U.S. Cl.
CPC ..... *B65F 1/1415* (2013.01); *B65B 67/04* (2013.01); *B65B 67/12* (2013.01)
USPC ..... 248/101; 248/98; 141/390; 15/257.7; 294/214

(58) Field of Classification Search
CPC ..... B65B 67/12; B65B 67/04; B65F 1/1415
USPC ..... 248/98, 101; 141/390, 108; 15/257.1, 15/257.7; 294/214
See application file for complete search history.

(56) References Cited

U.S. PATENT DOCUMENTS

| | | | | | |
|---|---|---|---|---|---|
| 422,274 | A | * | 2/1890 | Wilkinson | 248/98 |
| 430,355 | A | * | 6/1890 | Stone | 141/108 |
| 1,410,369 | A | | 3/1922 | Moise | |
| 1,765,346 | A | * | 6/1930 | Rosenfeld | 141/314 |
| 2,423,711 | A | * | 7/1947 | Knox | 16/26 |
| 2,782,615 | A | | 2/1957 | Johnson | |
| 2,902,705 | A | | 9/1959 | Eistrup | |
| 3,026,138 | A | * | 3/1962 | Homer et al. | 294/178 |
| 3,451,690 | A | * | 6/1969 | Cravens | 280/40 |
| 3,747,653 | A | | 7/1973 | Ringer | |
| 3,986,744 | A | | 10/1976 | Krogstad et al. | |
| 4,357,728 | A | | 11/1982 | Pravettone | |
| 4,442,567 | A | | 4/1984 | Pravettone | |
| 4,709,440 | A | * | 12/1987 | Conelly | 15/257.3 |
| 4,749,158 | A | * | 6/1988 | Buckley | 248/98 |
| 4,787,753 | A | | 11/1988 | Barnhart | |
| 4,796,938 | A | * | 1/1989 | Knights | 294/178 |
| 4,802,258 | A | | 2/1989 | Jensen | |
| 5,031,277 | A | | 7/1991 | Coker | |
| 5,040,754 | A | | 8/1991 | Dearman | |
| 5,083,731 | A | | 1/1992 | Fullilove | |
| 5,107,666 | A | * | 4/1992 | Rahtican | 56/202 |
| 5,180,125 | A | | 1/1993 | Caveney | |
| 5,195,765 | A | * | 3/1993 | Lacey, Jr. | 280/47.26 |
| 5,222,536 | A | * | 6/1993 | Hodgdon et al. | 141/390 |
| 5,575,520 | A | * | 11/1996 | Northcutt | 294/179 |
| 5,655,739 | A | * | 8/1997 | Teh-Wah Goo | 248/101 |
| 5,671,858 | A | * | 9/1997 | Hsu | 220/9.2 |
| 5,806,416 | A | * | 9/1998 | Cerniglia et al. | 100/90 |

(Continued)

*Primary Examiner* — Jonathan Liu
*Assistant Examiner* — Chiedu Chibogu
(74) *Attorney, Agent, or Firm* — Kyle A. Fletcher, Esq.

(57) ABSTRACT

The dustpan with garbage bag supporting frame, filter, and running boards includes a dustpan of hollowed construction from which the garbage bag supporting frame attaches to a rear of said dustpan. The dustpan includes a plurality of interchangeable filters that can attach to a front opening and/or rear opening in order to sift or filter out debris swept into and through said dustpan. The garbage bag supporting frame attaches onto opposing exterior surfaces of said dustpan. Both the garbage bag supporting frame and the dustpan include running boards that attach there under, and which enable mobilization there to. The running board for use with the garbage bag supporting frame may further include an according-styled cover that extends to cover the garbage bag supporting frame as well as a trash bag contained therein.

8 Claims, 7 Drawing Sheets

(56) References Cited

U.S. PATENT DOCUMENTS

| | | | | |
|---|---|---|---|---|
| 5,820,179 | A | 10/1998 | Tsou | |
| 6,003,820 | A | 12/1999 | Baldonado | |
| 6,082,574 | A * | 7/2000 | Johnson | 220/495.1 |
| 6,116,548 | A * | 9/2000 | Oleson | 248/97 |
| 6,135,518 | A * | 10/2000 | Holthaus | 294/214 |
| 6,513,845 | B2 * | 2/2003 | Campomane | 294/19.2 |
| 6,643,892 | B1 | 11/2003 | Murphy | |
| 6,679,948 | B2 | 1/2004 | Mead | |
| 6,708,742 | B2 * | 3/2004 | Weathers et al. | 141/391 |
| 6,962,106 | B2 * | 11/2005 | Viraldo | 99/339 |
| 6,994,302 | B1 | 2/2006 | Simmons | |
| 7,066,220 | B1 * | 6/2006 | Take et al. | 141/391 |
| 7,144,019 | B2 | 12/2006 | Lee | |
| 7,252,207 | B2 * | 8/2007 | Liao | 220/495.11 |
| 7,281,690 | B2 * | 10/2007 | Kelley | 248/97 |
| 7,686,360 | B2 * | 3/2010 | Platt | 294/1.3 |
| 7,703,723 | B1 * | 4/2010 | Cooper et al. | 248/97 |
| 8,047,477 | B2 * | 11/2011 | Wilkinson | 248/99 |
| 8,714,568 | B2 * | 5/2014 | Allam et al. | 280/30 |
| 2006/0243867 | A1 * | 11/2006 | Strickland et al. | 248/101 |
| 2006/0283863 | A1 * | 12/2006 | Coles | 220/495.08 |
| 2013/0019995 | A1 * | 1/2013 | Muse | 141/340 |
| 2013/0313377 | A1 * | 11/2013 | Struck, II | 248/98 |

* cited by examiner

DUSTPAN WITH GARBAGE BAG SUPPORTING FRAME, FILTER, AND RUNNING BOARDS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of dustpans with bag supporting devices, more specifically, a wheeled garbage bag supporting device for use in conjunction with a dustpan that includes a spring-loaded filter assembly, and which can support the garbage bag in either a vertical or horizontal orientation.

B. Discussion of the Prior Art

As a preliminary note, it should be stated that there is an ample amount of prior art that deals with garbage bag supporting frames and dustpans, generally speaking. As will be discussed below, no piece of prior art discloses a wheeled garbage bag supporting frame that is of hollow construction thus enabling the bag to expand to the fullest capacity, and which attaches to the rear portion of a dustpan in support of a garbage bag there interchangeable filters that attach to a front opening of said dustpan as well as to a rear opening of said dustpan; wherein the garbage bag supporting frame attaches along outer side surfaces of the dustpan and is further secured thereon via a nylon strap that wraps around both the dustpan and the garbage bag supporting frame; wherein the garbage bag supporting frame rest atop of a wheeled running board, which clips onto a rear portion of said dustpan; wherein a dustpan running board may attach to a bottom surface of said dustpan so as to enable mobilization of the dustpan as well as the garbage bag supporting frame; wherein the dustpan may include a swivel handle that extends there from, and which enables manipulation of the dustpan and attached garbage bag supporting frame; wherein the garbage bag supporting frame may include a roller assembly that attaches to a rear surface, and which supports the frame upright with the garbage bag suspended within the garbage bag supporting frame.

The Lee Patent (U.S. Pat. No. 7,141,019) discloses a wheel barrow garbage can construction that has means to hold and open a trash bag with wheels and an extending handle. However, the wheelbarrow does not have a garbage bag supporting frame that supports a trash bag therein, and which attaches to a rear of a dustpan, and both of which being mobilized via running board thereon.

The Ringer Patent (U.S. Pat. No. 3,747,653) discloses a self-supporting receptacle for collecting lawn debris in which there is a triangular frame of rod material. However, the frame does not have a plurality of wheels or provide for an assembly that supports a trash bag to a rear of a dustpan.

The Barnhart Patent (U.S. Pat. No. 4,787,753) discloses a trapezoid shaped device for holding a plastic bag, which can lay on the ground and the user can sweep the debris directly into the bag. However, the device does not have a plurality of wheels or a box-like shape for use with a hollowed dustpan in communication with a garbage bag supporting frame attached about a rear opening of said dustpan.

The Baldonado et al. Patent (U.S. Pat. No. 6,003,820) discloses a plastic bag holding assembly for holding a plastic bag in an open position so that a single user may easily sweep debris into the open garbage bag. However, the device does not have wheels so as to make such device easily moved about, and the device does not have a garbage bag supporting frame that attaches to a rear of said dustpan.

The Jensen Patent (U.S. Pat. No. 4,802,258) discloses a combination dustpan and guide for filling trash containers. However, the dust pan does not support a garbage bag supporting frame.

The Jelincic Patent (U.S. Pat. No. 5,106,041) discloses a trash bag holder for holding open the mouth of a trash bag to facilitate filling with trash and being of triangular shape. Again, the device does not have wheels or a garbage bag supporting frame.

The Hodgdon et al. Patent (U.S. Pat. No. 5,222,536) discloses a refuse collector for introducing solid refuse into commercial plastic trash bags. Again, the device does not have a plurality of wheels. Also, the device rests inside of the plastic bag liner as opposed to supporting the top rim and about the exterior of the plastic trash bag.

The Joubert Patent Application Publication (U.S. Pub. No. 2005/0103950) discloses a refuse bag support that is capable of holding a bag in an open position as well as having a handle and wheels. However, the device does not support the bag in an open position along the ground, but rather in a vertical upright position.

While the above-described devices fulfill their respective and particular objects and requirements, they do not describe a wheeled garbage bag supporting frame that is of hollow construction thus enabling the bag to expand to the fullest capacity, and which attaches to the rear portion of a dustpan in support of a trash bag there from; wherein the dustpan includes a plurality of interchangeable filters that attach to a front opening of said dustpan as well as to a rear opening of said dustpan; wherein the garbage bag supporting frame attaches along outer side surfaces of the dustpan and is further secured thereon via a nylon strap that wraps around both the dustpan and the garbage bag supporting frame; wherein the garbage bag supporting frame rest atop of a wheeled running board, which clips onto a rear portion of said dustpan; wherein a dustpan running board may attach to a bottom surface of said dustpan so as to enable mobilization of the dustpan as well as the garbage bag supporting frame; wherein the dustpan may include a swivel handle that extends there from, and which enables manipulation of the dustpan and attached garbage bag supporting frame; wherein the garbage bag supporting frame may include a roller assembly that attaches to a rear surface, and which supports the frame upright with the garbage bag suspended within the garbage bag supporting frame. In this regard, the dustpan with garbage bag supporting frame, filter, and running boards departs from the conventional concepts and designs of the prior art.

SUMMARY OF THE INVENTION

The dustpan with garbage bag supporting frame, filter, and running boards includes a dustpan of hollowed construction from which the garbage bag supporting frame attaches to a rear of said dustpan. The dustpan includes a plurality of interchangeable filters that can attach to a front opening and/or rear opening in order to sift or filter out debris swept into and through said dustpan. The garbage bag supporting frame attaches onto opposing exterior surfaces of said dustpan. Both the garbage bag supporting frame and the dustpan include running boards that attach there under, and which enable mobilization there to. The running board for use with the garbage bag supporting frame may further include an according-styled cover that extends to cover the garbage bag supporting frame as well as a trash bag contained therein. The garbage bag supporting frame may support a garbage bag from within or outside thereof depending upon its use.

It is an object of the invention to provide a dustpan from which a garbage bag supporting frame attaches to a rear end in order to support a trash bag at a rear of said dustpan.

A further object of the invention is to provide a garbage bag supporting frame that attaches on outer side surfaces of said dustpan, and which holes an opening of a garbage bag in an open position such that debris can be collected in said dustpan and pass into said open garbage bag.

An even further object of the invention is to include roller assemblies that attach onto rear, exterior portions of the garbage bag supporting frame such that a garbage bag may optionally be placed inside of and supported in an open position within the garbage bag supporting frame while in an erect orientation with the dustpan attached there above.

Another object of the invention is to provide a plurality of interchangeable filters that can attach to the front and/or rear opening of said dustpan in order to sift out debris collected via the dustpan.

Another object of the invention is to provide a running board for use with the garbage bag supporting frame, which attaches to the rear of the dustpan, and which enables the garbage bag supporting frame to roll behind said dustpan.

An even further object of the invention is to provide a cover that extends from opposing said of said running board in order to wrap around the garbage bag supporting frame.

An even further object of the invention is to provide a running board that can attach to a bottom surface of said dustpan, and which enables the dustpan to roll.

These together with additional objects, features and advantages of the dustpan with garbage bag supporting frame, filter, and running boards will be readily apparent to those of ordinary skill in the art upon reading the following detailed description of presently preferred, but nonetheless illustrative, embodiments of the dustpan with garbage bag supporting frame, filter, and running boards when taken in conjunction with the accompanying drawings.

In this respect, before explaining the current embodiments of the dustpan with garbage bag supporting frame, filter, and running boards in detail, it is to be understood that the dustpan with garbage bag supporting frame, filter, and running boards is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dustpan with garbage bag supporting frame, filter, and running boards.

It is therefore important that the claims be regarded as including such equivalent construction insofar as they do not depart from the spirit and scope of the dustpan with garbage bag supporting frame, filter, and running boards. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
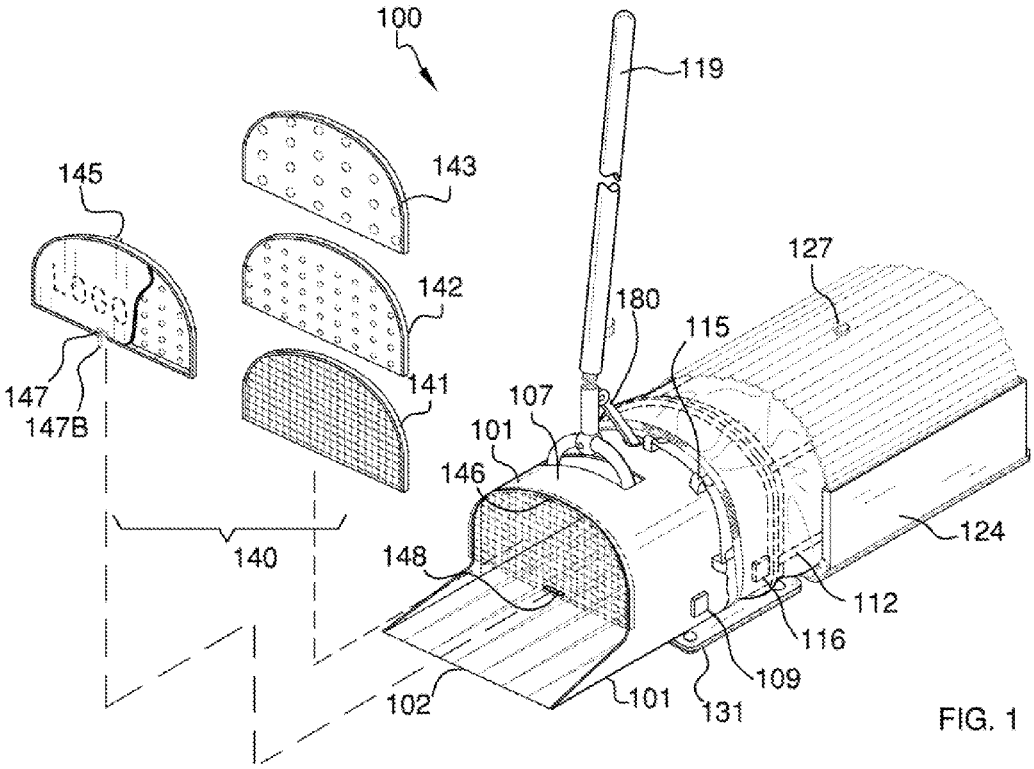
FIG. 1 illustrates a front, perspective view of the dustpan with garbage bag supporting frame, filter, and running boards in which a garbage bag is supported upon the garbage bag supporting frame, which is attached behind said dustpan and covered via the extendable cover of the respective running board, and further detailing some of the interchangeable filters that attach to the front of said dustpan.

Detailed reference will now be made to the preferred embodiment of the present invention, examples of which are illustrated in FIGS. 1-5. A dustpan with garbage bag supporting frame, filter, and running boards 100 (hereinafter invention) includes a dustpan 101 that is of hollowed construction, and further defined as including a front pan member 102, a front opening 103, and a rear opening 104. The dustpan 101 also includes a bottom surface 105, opposing, exterior side surfaces 106, and a top, exterior surface 107.

A garbage bag supporting frame 108 attaches onto the opposing, exterior side surfaces 106 via clips 109. A garbage bag 130 of standard construction slides over the rear opening 104, and is held in place thereon via the garbage bag supporting frame 108. A nylon strap 110 may be used to further secure both the garbage bag 130 and the garbage bag supporting frame 108 onto the dustpan 101.

The garbage bag supporting frame 108 is further defined by, an enclosing member 111 from which longitudinal members 112 extend rearwardly. Rear vertical members 113 attach pairs of longitudinal members 112. Brackets 114 extend forwardly from the enclosing member 111, and engage the clips 109 of the dustpan 101 thereby securing the garbage bag supporting frame 108 around the exterior of the dustpan 101.

It shall be noted that the opposing exterior side surfaces 106 of the dustpan 101 include a plurality of bag clips 115, which clip onto the opening of the garbage bag 130 in order to secure the garbage bag 130 to the dustpan 101. It shall be noted that the garbage bag 130 is secured onto the exterior of the dustpan 101 prior to attachment of the garbage bag supporting frame 108 to the dustpan 101.

Also, it shall be noted that guides 116 are aligned on the opposing, exterior side surfaces 106 of the dustpan 101, and support and align the garbage bag supporting frame 108 thereon.

It shall be further noted that vertical roller assemblies 117 are included with the invention 100. The vertical roller assemblies 117 attach onto the rear vertical members 113 of the garbage bag supporting frame 108, and enable the garbage bag supporting frame 108 to roll when in a vertical orientation (see FIG. 2A). More specifically, each vertical roller assembly 117 includes at least one roller ball 118 that rolls with respect to the vertical roller assembly 117. The vertical roller assemblies 117 include nubs 117A for attachment with holes 113A located on the rear vertical members 113 (see FIG. 2).

The dustpan 101 includes a pivotable handle 119 that attaches to the top surface 107 of the dustpan 101. It shall be further noted that the pivotable handle 119 is located forwardly on the top surface 107 thereby providing clearance for both the garbage bag 130 and the garbage bag supporting frame 108. The pivotable handle 119 is capable of rotating with respect to the dustpan 101, and such movement is well known in the art as it pertains to dustpans, generally.

The garbage bag supporting frame 108 may include a running board 120 that rests under the garbage bag supporting frame 108, but attaches to the rear opening 104 of the dustpan 101. More specifically, a hook 121 is provided on the running board 120, and hooks onto a loop 122 located on the rear opening 104 at the bottom surface 105 of the dustpan 101. The running board 120 enables the garbage bag supporting frame 108 to roll behind the dustpan 101. The running board 120 includes at least one roller ball 123 that is built into the running board 120, and which enables the running board 120 to roll upon a ground surface.

The running board 120 may further include an extendable cover 124 that extends along opposing side surfaces 125 of the running board 120. The extendable covers 124 extend to wrap around over top of the garbage bag supporting frame 108. The extendable covers 124 include a loop 126 and a button 127, which connect with one another to secure the extendable covers 124 over top of the garbage bag supporting frame 108 (see FIG. 1).

It shall be noted that the running board 120 may include a second loop 128 along a rear edge 129 of the running board 120 such that successive running boards 120 may attach to one another in order to support an elongated garbage bag supporting frame 108 and/or elongated garbage bag 130.

A dustpan running board 131 attaches to the bottom surface 105 of the dustpan 101. The dustpan running board 131 in conjunction with the running board(s) 120 enables the invention 100 to be mobilized. It shall be noted that the dustpan running board 131 will include the loop 122 thereon as opposed to on the dustpan 101 as described above in order to provide clearance for the garbage bag 130 around the dustpan 101.

The invention 100 further includes a plurality of interchangeable filters 140, which attach onto either the front opening 103 and/or the rear opening 104 of the dustpan 101. The interchangeable filters 140 are designed to sift out debris that collects on the front pan member 102 of the dustpan 101 or once inside of the dustpan 101.

In referring to FIG. 1, the interchangeable filters 140 have a screen filter 141, an intermediate filter 142, and a heavy debris filter 143. The screen filter 141 enables small debris to pass there through as opposed to the intermediate filter 142 and the heavy debris filter 143.

The interchangeable filters 140 are attachable to the rear opening 104, and in said situation, include an additional feature. The interchangeable filters 140 include a spring-loaded hinge 145 that clips onto a filter bracket 146 located on the rear opening 104 of the dustpan 101. The spring-loaded hinge 14 shall bias the interchangeable filter 140 outwardly in a horizontal orientation with respect to the dustpan 101.

Figure 5:
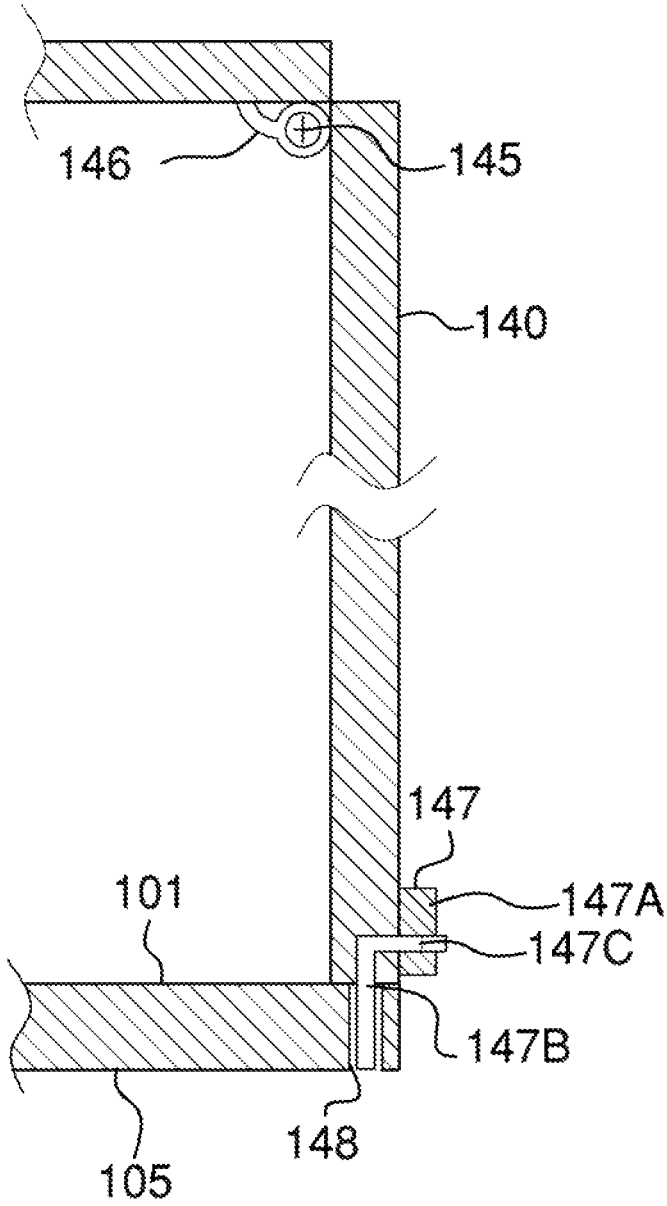
FIG. 5 illustrates a cross-sectional view of the dustpan with an attached interchangeable filter at the rear opening, and further detailing the spring-loaded lock that engages the slot provided on the dustpan.

The interchangeable filter 140 also includes a spring-loaded lock 147 that extends downwardly to engage a slot 148 provided on the bottom surface 105 of the dustpan 101 (see FIG. 5). A spring 147A located within the spring-loaded lock 147 biases a locking bar 147B downwardly in order to engage the slot 148. Upon lifting of a knob 147C, the locking bar 147B clears the slot 148, and enables the interchangeable filter 140 to rotate outwardly to a horizontal position as in FIG. 2.

Figure 1A:
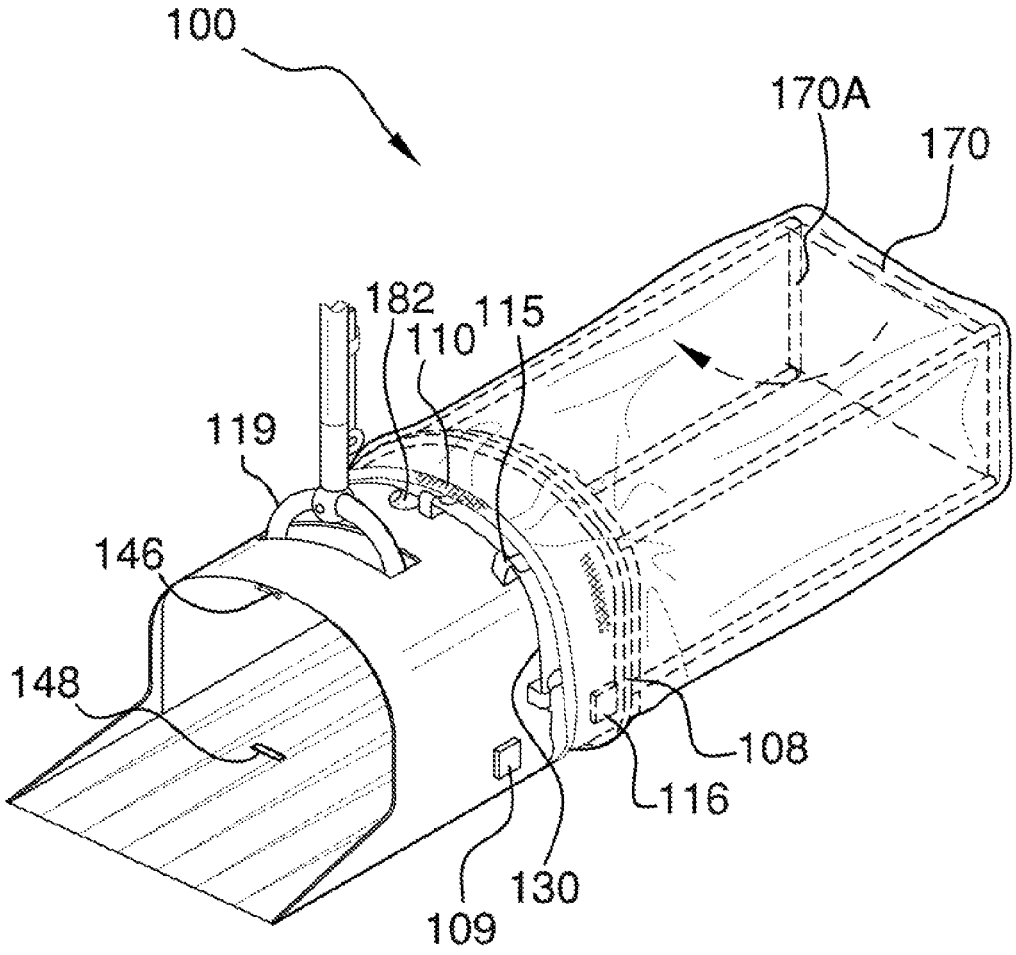
FIG. 1A illustrates a front, perspective view of the garbage bag supporting frame inserted inside of the garbage bag, and further attached to the rear of the dustpan.
Figure 2:
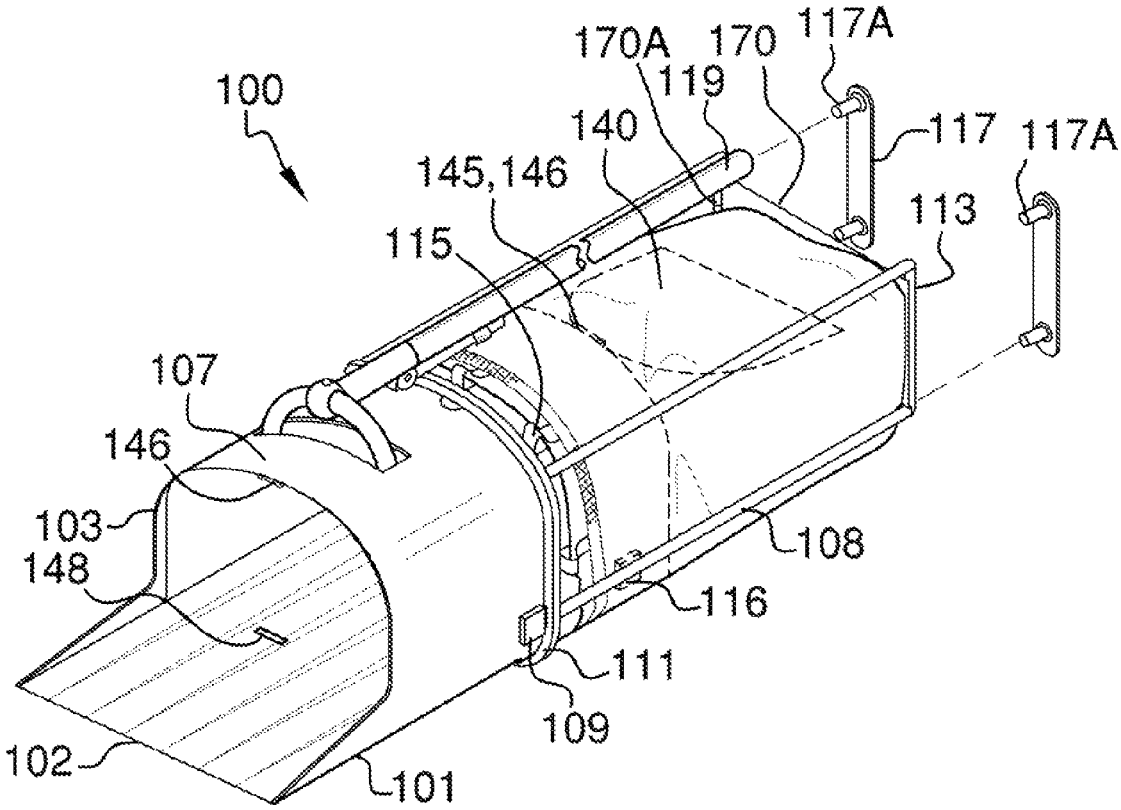
FIG. 2 illustrates a front, perspective view of the dustpan in which the garbage bag supporting frame is attached thereon, and detailing the garbage bag supporting therein as well as a rear filter rotated upwardly therein, and further detailing roller assemblies on a rear surface of said garbage bag supporting frame.
Figure 2A:
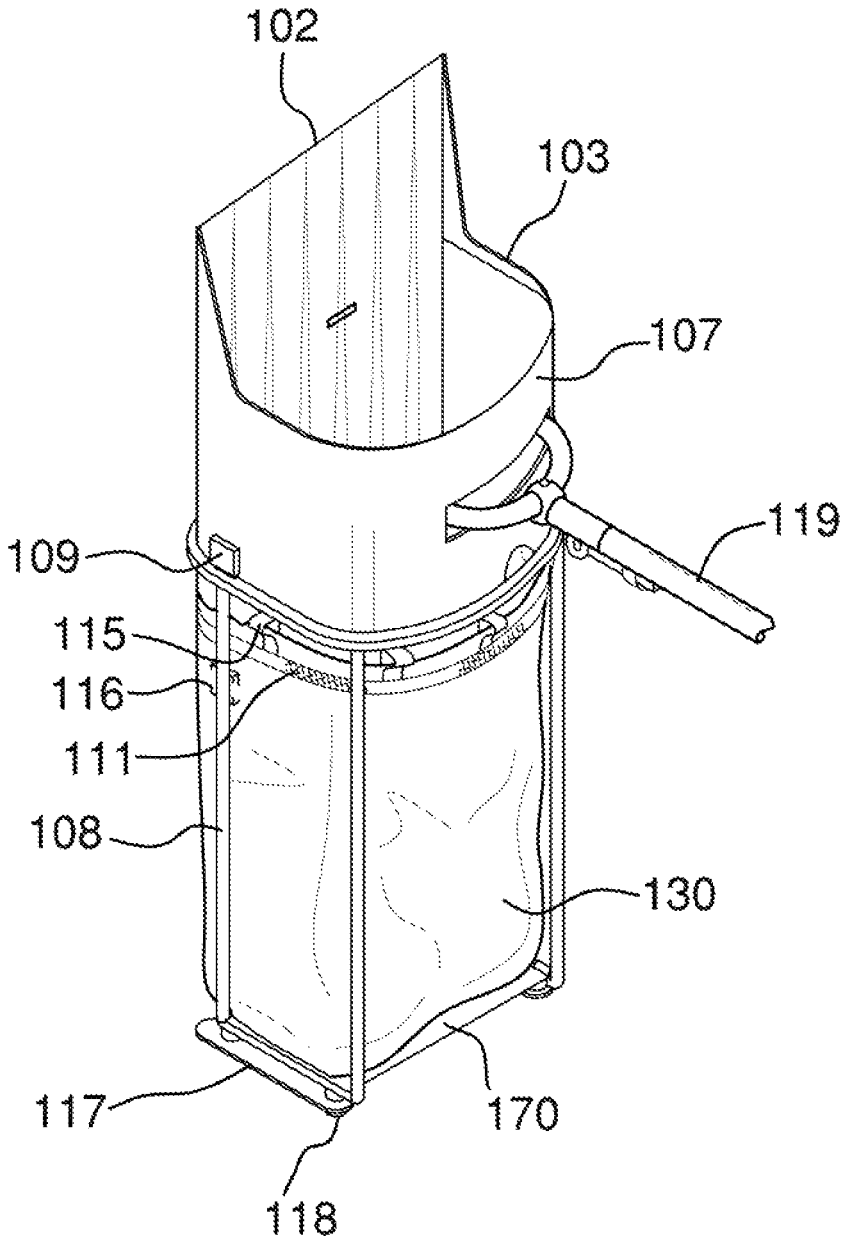
FIG. 2A illustrates another view of the garbage bag supporting frame in an erect orientation with the roller assemblies attached, and with the garbage bag suspended therein.
Figure 3:
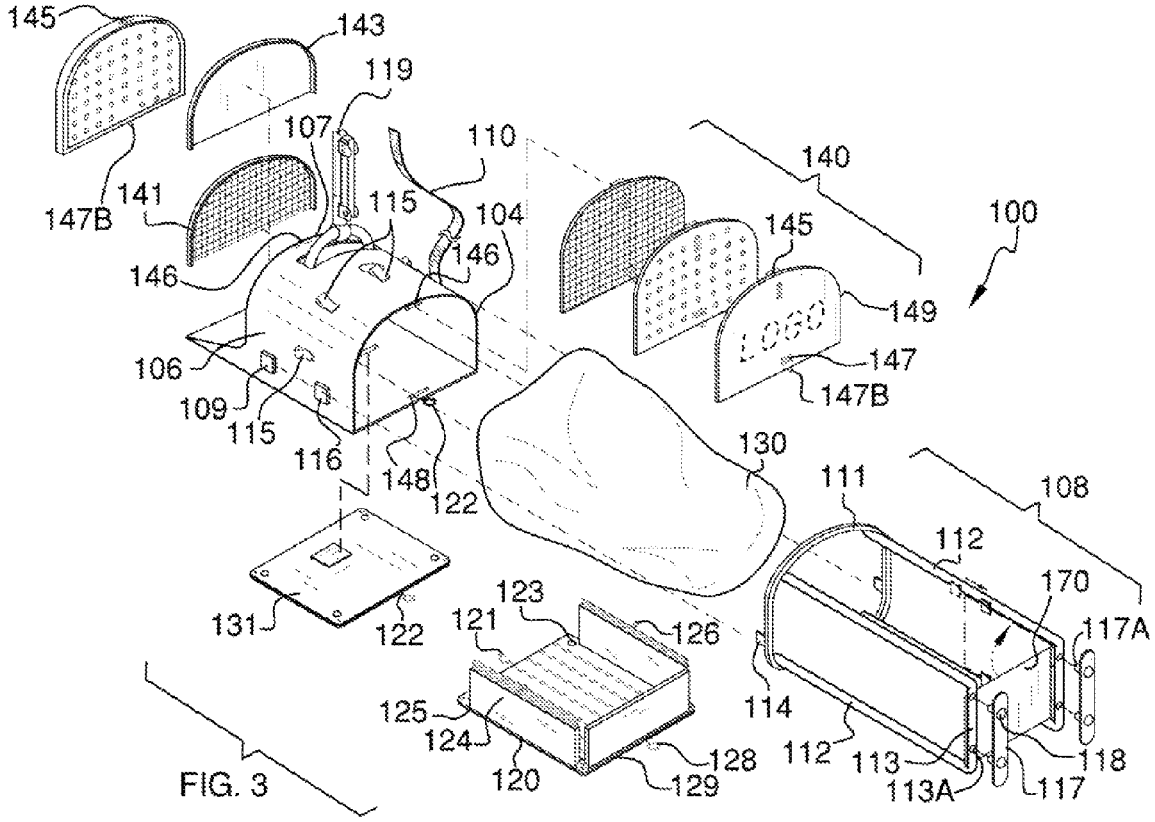
FIG. 3 illustrates a rear, perspective view of the dustpan with garbage bag supporting frame, filter, and running boards in an exploded state with the various filters detached from the dustpan as well as the running board detached from both the dustpan and the garbage bag supporting frame.

Referring to FIGS. 2 and 2A it shall be noted that the garbage bag 130 may be supported inside of and within the garbage bag supporting frame 108 as opposed to placing the garbage bag supporting frame 108 inside of the garbage bag 130 as depicted in FIGS. 1 and 1A. Thus, the garbage bag supporting frame 108 holds the garbage bag 130 in an open condition as depicted in FIGS. 1 and 1A, whereas the garbage bag supporting frame 108 surrounds the garbage bag 130 as depicted in FIGS. 2 and 2A. The vertical roller assemblies 117 are used to provide mobility to the invention 100 when so used in the manner as depicted in FIG. 2A.

The garbage bag supporting frame 108 may include a folding floor 170. Moreover, the folding floor 170 spans across the vertical members 113. The folding floor 170 attaches to and pivots about one of the vertical members 113 via a floor hinge 170A. The folding floor 170 rotates from a horizontal orientation to a vertical orientation as depicted in FIG. 1A. Moreover, the folding floor 170 is included with the invention 100, to provide support to the garbage bag 130 along the bottom surface of the garbage bag 130 when held in an erect orientation. The folding floor 170 can rotate to the vertical orientation and be generally parallel with the vertical members 113 when the bottom of the garbage bag 130 does not need support from underneath.

Figure 4:
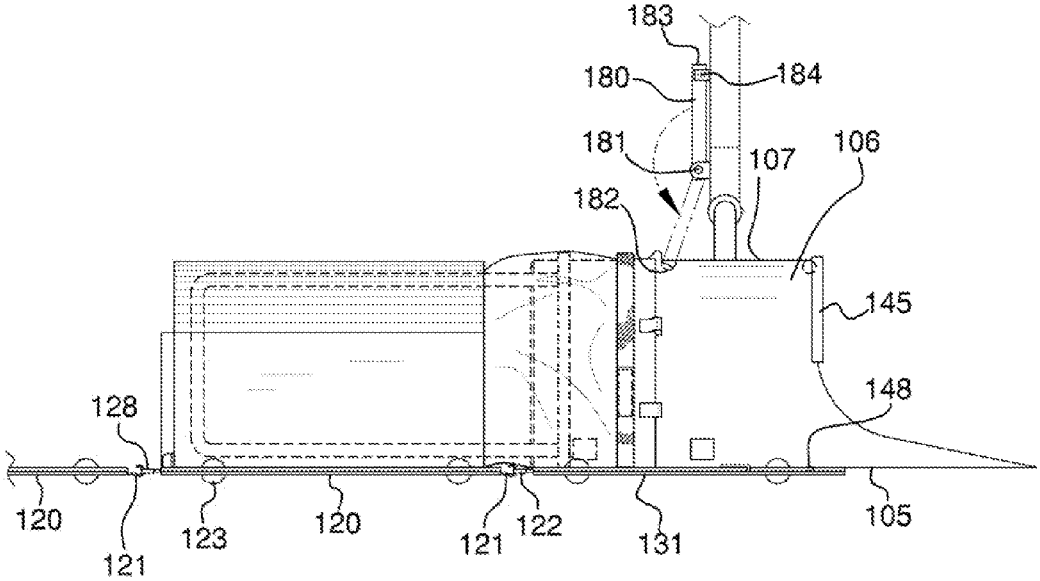
FIG. 4 illustrates a side view of the dustpan with garbage bag supporting frame, filter, and running boards.

The invention 100 may further include an arm stabilizer 180 that is rotatably engaged with respect to the pivotable handle 119. Referring to FIG. 4, the arm stabilizer 180 attaches to and rotates about the arm stabilizer 180 at a stabilizer pivot point 181. The arm stabilizer 180 to rotate from a parallel orientation with the pivotable handle 119 to an acute angle therewith. The arm stabilizer 180 is used to lock the pivotable handle 119 at a perpendicular orientation with respect to the top surface 107 of the dustpan 101. The top surface 107 of the dustpan 101 includes a stabilizer notch 182 thereon, which receives a distal end 183 of the stabilizer arm 180. The pivotable handle 119 includes a stabilizer bracket 184, which is used to lock the stabilizer arm 180 there against when not in use with the dustpan 101.

The invention 100 may further include a covered filter 149 that is not a screen or filter, and does not enable debris to be screened or otherwise sifted there through. The covered filter 149 can attach to the dustpan 101 either at the front opening 103 or the rear opening 104 for use in connection therewith. If the covered filter 149 is connected to the rear opening 104, and is at a down and locked position there over, then no garbage bag 130 is needed for use with the dustpan 101, and the dustpan 101 can operate in a traditional manner. However, if the covered filter 149 is connected to the rear opening 104 and is locked in an up position, then the garbage bag 130 is needed to collect debris that passes through the dustpan 101.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A dustpan with garbage bag supporting frame comprising:

a dustpan in which a garbage bag is attached around opposing, exterior side surfaces and secured therein via a plurality of bag clips provided on the dustpan;

wherein a garbage bag supporting frame attaches to said dustpan by clips located on said opposing, exterior side surfaces via brackets disposed on the garbage bag supporting frame such that the garbage bag supporting frame supports the garbage bag;

said garbage bag attaches to and is opened adjacent a rear opening of said dustpan;

wherein the garbage bag supporting frame is placed inside of or outside of said garbage bag so that the garbage bag is held in an open condition or surrounded, respectively;

wherein a running board having at least one roller ball integrated therein is placed under said garbage bag supporting frame to enable mobilization thereof;

wherein the running board includes extendable covers on opposing sides, which extend to wrap around over a top of the garbage bag supporting frame and cover the garbage bag supporting frame;

wherein the dustpan is further defined with a front pan member onto which debris is swept thereon, a front opening, a bottom surface, and a top, exterior surface from which a pivotable handle attaches;

wherein a plurality of interchangeable filters attach onto either the front opening and/or the rear opening of the dustpan.

2. The dustpan with garbage bag supporting frame as described in claim 1 wherein the running board attaches to a dustpan running board via a hook and loop; wherein the dustpan running board attaches to the bottom surface of said dustpan, and enables said dustpan to roll.

3. The dustpan with garbage bag supporting frame as described in claim 2 wherein the running board includes a second loop along a rear edge of the running board configured for attaching successive running boards to the running board.

4. The dustpan with garbage bag supporting frame as described in claim 1 wherein the interchangeable filters attach to the rear opening include a spring-loaded hinge that clips onto a filter bracket located on the rear opening of the dustpan; wherein the spring-loaded hinge biases the interchangeable filter outwardly in a horizontal orientation with respect to the dustpan.

5. The dustpan with garbage bag supporting frame as described in claim 4 wherein the interchangeable filter also includes a lock that extends downwardly to engage a slot provided on the bottom surface of the dustpan; whereupon lifting of a knob, the locking bar clears the slot, and enables the interchangeable filter to rotate outwardly to a horizontal position.

6. A dustpan with garbage bag supporting frame comprising:

a dustpan in which a garbage bag is attached around opposing, exterior side surfaces and secured therein via a plurality of bag clips provided on the dustpan;

wherein a garbage bag supporting frame attaches to said dustpan by clips located on said opposing, exterior side surfaces via brackets disposed on the garbage bag supporting frame such that the garbage bag supporting frame supports the garbage bag;

said garbage bag attaches to and is opened adjacent a rear opening of said dustpan;

wherein the garbage bag supporting frame is placed inside of or outside of said garbage bag so that the garbage bag is held in an open condition or surrounded, respectively;

wherein a running board having at least one roller ball integrated therein is placed under said garbage bag supporting frame to enable mobilization thereof;

wherein the running board includes extendable covers on opposing sides, which extend to wrap around over a top of the garbage bag supporting frame and cover the garbage bag supporting frame;

wherein the dustpan is further defined with a front pan member onto which debris is swept thereon, a front opening, a bottom surface, and a top, exterior surface from which a pivotable handle attaches;

wherein a plurality of interchangeable filters attach onto either the front opening and/or the rear opening of the dustpan; wherein the interchangeable filters attach to the rear opening include a spring-loaded hinge that clips onto a filter bracket located on the rear opening of the dustpan; wherein the spring-loaded hinge biases the interchangeable filter outwardly in a horizontal orientation with respect to the dustpan; wherein the interchangeable filter also includes a lock that extends downwardly to engage a slot provided on the bottom surface of the dustpan; whereupon lifting of a knob, the locking bar clears the slot, and enables the interchangeable filter to rotate outwardly to a horizontal position.

7. The dustpan with garbage bag supporting frame as described in claim 6 wherein the running board attaches to a dustpan running board via a hook and loop; wherein the dustpan running board attaches to the bottom surface of said dustpan, and enables said dustpan to roll.

8. The dustpan with garbage bag supporting frame as described in claim 7 wherein the running board includes a second loop along a rear edge of the running board configured for attaching successive running boards to the running board.

* * * * *